US005609728A

United States Patent [19]

Durden

[11] Patent Number: 5,609,728

[45] Date of Patent: Mar. 11, 1997

[54] METHOD AND APPARATUS FOR TRANSFERRING A WEB FROM A FORMING WIRE TO A TRANSFERRING FELT IN A PAPER MAKING MACHINE

[75] Inventor: Phillip R. Durden, Merdian, Miss.

[73] Assignee: James River Corporation of Virginia, Richmond, Va.

[21] Appl. No.: 540,037

[22] Filed: Oct. 6, 1995

Related U.S. Application Data

[63] Continuation-in-part of Ser. No. 409,642, Mar. 24, 1995.

[51] Int. Cl.[6] ..... D21F 2/00

[52] U.S. Cl. ..... 162/205; 162/306; 162/203; 162/361; 162/363

[58] Field of Search ..... 162/306, 202, 162/358.3, 205, 203, 210, 361, 363

[56] References Cited

U.S. PATENT DOCUMENTS

| | | | |
|---|---|---|---|
| 2,732,772 | 1/1936 | Hornbostel . | |
| 2,869,437 | 1/1959 | Hornbostel et al. . | |
| 3,441,476 | 4/1969 | Schiel . | |
| 3,537,955 | 11/1970 | Huerta et al. . | |
| 3,649,449 | 3/1972 | Nykopp . | |
| 3,992,253 | 11/1976 | Schiel . | |
| 4,110,156 | 8/1978 | Stotz et al. | 162/305 |
| 4,113,557 | 9/1978 | Kankaanpää . | |
| 4,224,104 | 9/1980 | Kanpaanpää | 162/205 |
| 4,236,962 | 12/1980 | Kankaanpää . | |
| 4,406,739 | 9/1983 | Kanpaanpää | 162/203 |
| 4,440,597 | 4/1984 | Wells et al. . | |
| 4,875,976 | 10/1989 | Wedel . | |
| 5,147,508 | 9/1992 | Sweet . | |
| 5,238,535 | 8/1993 | Kraft . | |
| 5,328,569 | 7/1994 | Cronin . | |

FOREIGN PATENT DOCUMENTS

| | | |
|---|---|---|
| 1573109 | 7/1969 | France . |
| 2105091 | 5/1972 | Germany . |

*Primary Examiner*—Donald E. Czaja
*Assistant Examiner*—Jose A. Fortuna
*Attorney, Agent, or Firm*—Sixbey, Friedman, Leedom & Ferguson, P.C.; Charles M. Leedom, Jr.; Donald R. Studebaker

[57] ABSTRACT

A method and apparatus for transferring a web from a forming fabric in a forming section of a paper making machine to a transfer felt or fabric is disclosed including directing the web carrying forming fabric in a substantially longitudinal direction adjacent an underside of a transfer shoe in a transfer zone the said web being positioned between the forming fabric and the transfer shoe and the transfer shoe having a substantially planer lead-in surface and an arcuate exiting surface of a predetermined radius, the lead-in surface including an arcuate trailing edge having a predetermined radius less than that of the arcuate exiting surface with the trailing edge and the exiting surface being separated by a suction opening, directing the transfer felt in a substantially longitudinal direction adjacent the underside of the transfer shoe with the transfer felt being positioned between the web and the transfer shoe, the transfer felt entering the transfer zone at an angle with respect to the forming wire, creating a nip region adjacent the arcuate trailing edge where the transfer felt is pressed against the web in a concentrated area for initiating the transfer of the web from the forming fabric to the transfer felt, applying a suction to the web through the transfer felt adjacent the suction opening whereby the web is transferred from the forming fabric to the transfer felt and directing the transfer felt and transferred web over the arcuate exiting surface and away from the forming fabric such that a greater transfer force is realized in the transfer zone than with previous transfer devices.

23 Claims, 3 Drawing Sheets

METHOD AND APPARATUS FOR TRANSFERRING A WEB FROM A FORMING WIRE TO A TRANSFERRING FELT IN A PAPER MAKING MACHINE

This application is a continuation-in-part application of U.S. application Ser. No. 08/409,642, filed Mar. 24, 1995.

TECHNICAL FIELD OF THE INVENTION

The present invention relates generally to a method and apparatus for use in a paper making machine and more particularly to a method and apparatus for separating a web from a forming wire and transferring the web to a transfer felt for further processing.

BACKGROUND OF THE INVENTION

The separation of a web from the forming wire in a forming section of a paper making machine and its transfer to a transfer felt is a critical step in the paper making process since this separation and transfer significantly influences the reliability and operation of the paper making machine as a whole. It is well known that in paper making machines which operate at low speeds, it is possible to use an open draw based upon the difference in speeds and travel of the web carrying forming wire and the transfer felt to transfer the web from the forming wire to the felt.

However, in paper making machines which operate at relatively high speeds which manufacture thin and consequently low strength paper, it is necessary to use a closed draw in the separation of the web from the forming wire and its transfer to the transfer felt.

Closed draw arrangements for separating a web from the forming wire and transferring the same to the press section of the paper making machine generally include a substantially continuous loop of transfer felt belonging to the press section of the paper making machine which is guided into contact with the web carried by the forming wire. The transfer felt is urged against the web carried by the forming wire such as by a rotating roller where upon the web adheres to the transfer felt and is thus transferred from the forming wire to the transfer felt and continues on to the press section of the paper making machine.

Generally, there are two types of closed systems for accomplishing the transfer of the web from the forming wire to the transfer felt. More particularly, the simpler of these arrangements, commonly termed "lick up transfer" utilizes a wet transfer felt which contacts the web to "lick up" the web by adhering the web to the surface of the transfer felt due to its wet nature. The other type of closed transfer system is generally termed a "vacuum pick up" wherein a vacuum ensures the adherence of the web to the transfer felt. A vacuum pick up system is generally more desirable than a "lick up" system since the former provides a greater choice in the selection of the quality of the transfer felt. In this regard, where the transfer felt also functions as a press felt, certain requirements must be taken into account in the choice of the felt, namely, the web should securely adhere to the surface of the transfer felt at the point of separation from the forming wire while at the same time the transfer felt must function in an efficient manner at the water removing press roll nip. These requirements, however, are often contradictory in that in order for the web to securely adhered to the felt at the separation station and to remain in adherence to the lower surface of the felt over a span between the pick up point and the first press roll nip, the felt must be relatively wet. However, as the moisture content of the felt is increased to facilitate adherence of the web to the felt, the dewatering capabilities i.e. the absorbency of the felt is correspondingly decreased, therefore rendering the water capacity at the press nip relatively inefficient. This is a distinct disadvantage in conventional vacuum pick up arrangements.

Vacuum pick up systems which utilize separate pick up suction rolls are known and are widely used in paper making machines. For example, such a system is used in a Fourdrinier Machine wherein the web is separated from the forming wire at a point located on the run of the forming wire between the chauffeur roll and the draw roll, the forming wire sloping during such run at an angle of about 45° to the horizontal. The particular point at which the web is separated from the forming wire and is transferred to the transfer felt is determined by the particular design of the wire and press sections and their mutual locations. After the web is separated from the forming wire and becomes adhered to the transfer felt, the web carrying transfer felt wraps the pick up roll through a sector of about 45° to 90° where upon the web carrying the transfer felt moves onward to the press section.

Such vacuum pick up systems which utilize separate pick up suction rolls are often disadvantageous in that under certain conditions such as high speed paper making processes, the change of direction undergone by the web carried by the transfer felt on the pick up suction roll causes the web to loosen from the transfer felt due to the centrifugal forces acting thereon. In order to prevent this separation, the pick up roll is usually provided with a suction zone that extends beyond the actual zone wherein the web is separated from the forming wire. Although, this provision ensures that the web will remain adhered to the felt, the extension of the suction zone requires a corresponding considerable increase in the capacity of the vacuum system for the suction roller. Accordingly, systems of this type require a greater vacuum capacity than in arrangements where suction is only required to transfer the web from the forming wire to the transfer felt.

In order to at least partially alleviate some of the problems discussed hereinabove, a stationary transfer suction box has been utilized for separating the web from the forming wire rather than the use of vacuum pick up rolls. In this regard, U.S. Pat. No. 3,537,955 discloses a pick up arrangement for a paper making machine wherein a vacuum pick up shoe is provided for separating the web from the forming wire and transferring such web to a transfer felt for further processing. In such a device, the pick up shoe arrangement for removing a web from the forming surface of the forming wire includes an endless felt which is urged against the forming surface by means of a guide member having a curved surface in contact with the felt and a substantially planar surface diverging away from the felt thereby creating a pressure differential across the felt. However, with the pick up shoe described hereinabove, a significant vacuum source must be obtained in order to adequately transfer the web from the forming wire to the transfer felt.

In yet another paper manufacturing process, a transfer head or shoe including a convex facing surface having a transversely extending vacuum slot which communicates with a sufficient level of vacuum to effect transfer from the carrier fabric to the transfer felt is utilized. However, a significant force is required to impinge the transfer head against the transfer felt in order to effect sufficient transfer of the web from the forming wire to the transfer felt.

In yet another attempt to overcome the above-noted shortcomings, French Patent No. 1,573,109 discloses an automatic transferring apparatus for transferring a web from a forming wire to a transfer felt formed of a closed loop by means of a suction block mounted inside the felt loop and comprising a suction zone across the felt band which first contacts under pressure at a point of the transfer of the web carried by the forming wires so that a couching zone is established in which the three bands comprising the transfer felt, web and forming wire find themselves applied against the box. A perforated area of the suction box is provided to subject an inside surface of the transfer felt to a vacuum in order to effect transfer of the web from the forming wire to the transfer felt. However, again a significant force is necessary in order to transfer the web in the manner suggested.

Clearly, there is a need in the art for a web transfer device wherein a greater effective force can be generated in the couching zone for effecting sufficient transfer of the web from a forming wire to a transfer felt without jeopardizing the overall capacity of the paper making machine. Moreover, there is a need for a suction box construction wherein the overall production of the paper making machine is increased by increasing the pick up effectiveness of the transfer felt and reducing the number of breaks of the web during the paper making manufacturing process.

SUMMARY OF THE INVENTION

A primary object of the present invention is to provide a method and apparatus for transferring a web from a forming wire in a forming section of a paper making machine to a transfer felt while overcoming the aforementioned shortcomings associated with the prior art devices.

A further object of the present invention is to provide a pick up shoe for use in a paper making machine wherein the unit pressure needed to pick the web off the forming wire is increased significantly.

Yet another object of the present invention is to provide a pick up shoe for use in a high speed tissue production paper making machine wherein the production of such machine is increased by more than fifteen (15) tons per day.

A further object of the present invention is to provide a pick up shoe for use in a paper making machine wherein breakage of the web during the transfer of the web from a forming wire to a transfer felt is significantly reduced.

These, as well as additional objects of the present invention are achieved by providing a method and apparatus for transferring a web from a forming fabric in a forming section of a paper making machine to a transfer felt or fabric in a rapid and reliable manner. The method for transferring the web from a forming fabric in a forming section of a paper making machine to a transfer felt includes directing the web carrying forming fabric in a substantially longitudinal direction adjacent an underside of a transfer shoe in a transfer zone the said web being positioned between the forming fabric and the transfer shoe and the transfer shoe having a substantially planer lead-in surface and an arcuate exiting surface of a predetermined radius, the lead-in surface including an arcuate trailing edge having a predetermined radius less than that of the arcuate exiting surface with the trailing edge and the exiting surface being separated by a suction opening, directing the transfer felt in a substantially longitudinal direction adjacent the underside of the transfer shoe with the transfer felt being positioned between the web and the transfer shoe, the transfer felt entering the transfer zone at an angle with respect to the forming fabric, creating a nip region adjacent the arcuate trailing edge where the transfer felt is pressed against the web in a concentrated area for initiating the transfer of the web from the forming fabric to the transfer felt, applying a suction to the web through the transfer felt adjacent the suction opening whereby the web is transferred from the forming fabric to the transfer felt and directing the transfer felt and transferred web over the arcuate exiting surface and away from the forming fabric. The apparatus for transferring the web from the forming fabric to the transfer felt in the transfer zone of the paper making machine comprises a substantially continuous web carrying forming fabric travelling in a substantially closed loop and passing through the transfer zone, a substantially continuous transfer felt travelling in a substantially closed loop and passing through the said transfer zone, a transfer device for transferring the web from the forming fabric to the transfer felt, the transfer device including a substantially planer lead-in surface having an arcuate trailing edge of a predetermined radius and an arcuate exiting surface of a predetermined radius with the predetermined radius of the arcuate trailing edge being less than the predetermined radius of the arcuate exiting surface, a suction opening positioned between the lead-in surface and the arcuate exiting surface and a vacuum device for creating a vacuum in the suction opening for causing the web to transfer from the forming fabric to the transfer felt in the transfer zone wherein a greater transfer force is realized in the transfer zone than with previous transfer devices.

These as well as additional advantages of the present invention will become apparent from the following detailed description of the invention when read in light of the several figures.

DETAILED DESCRIPTION OF THE INVENTION

Referring now to the several figures, and particularly FIG. 1, the transfer device in accordance with the present invention will be described in detail.

Figure 1:
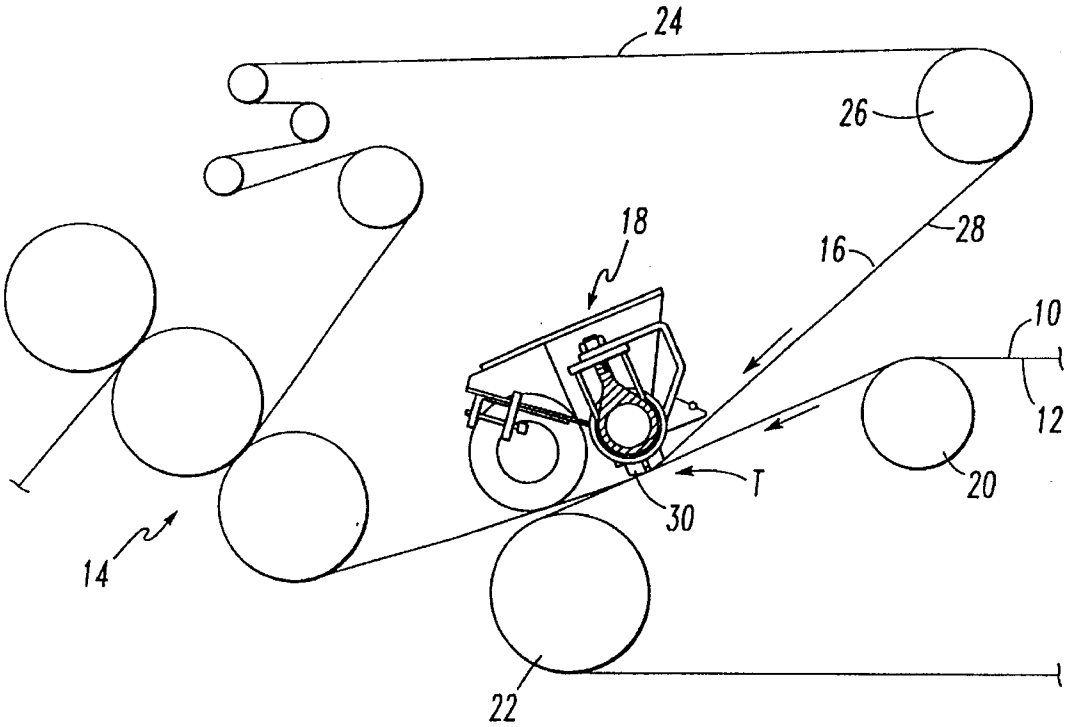
FIG. 1 is a diagrammatic view of a system which accommodates the web transfer device set forth in accordance with the present invention.

In the embodiment illustrated in FIG. 1, the transfer device in accordance with the present invention is set forth as being accommodated within a conventional paper making machine. From a pulp processing station (not shown), a web 10 is transferred on a forming fabric 12 to a press station 14 or alternatively to a Thru-Air-Drying (TAD dryer) or a yankee dryer with the web being transferred from the forming fabric 12 to a transfer felt or fabric 16 by way of a transfer device 18 between the press station 14 or other dryer and the processing and forming stations (not shown). The forming fabric 12 as well as the transfer felt 16 are formed in substantially continuous loops with the forming fabric 12, having the newly formed web 10 thereon, contacts the endless transfer felt 16 in the region T of the paper making machine due to the pressure applied by the transfer device 18. As will be discussed in greater detail hereinbelow, the web 10 is pressed between the forming fabric 12 and transfer felt 16 such that the web 10 adheres to the transfer felt 16 for further processing in the paper making machine. The forming fabric 10 is shown as being trained downwardly about a roll 20 in a downwardly inclined discharge run to and about a roll 22 spaced a substantial distance in advance of and below the roll 20 and about which the fabric changes its direction for a return run of the forming fabric. It should be noted that many other path configurations are possible as well.

The transfer felt 16 may be a conventional form of felt commonly used for pick up purposes and trained in an endless loop. The transfer felt 16 has a top run 24 which may be uniformly cleaned and moistened as it turns about a return roll 26 disposed above the transfer device 18. The transfer felt after passing over the idle roll 26 is directed along an approaching run 28 toward the forming fabric 12. From the return roll 26, the transfer felt passes downwardly in an inclined direction and is pressed to engage and travel with the web 10 and forming fabric 12 by the transfer device 18 and more particularly the transfer shoe 30 which is contoured and positioned to provide a relatively intense contact pressure between the transfer felt 16 and the forming fabric 12. A small angle of divergence is provided between the transfer felt 16 and the web 10 away from the forming fabric 12. The transfer shoe 30 and more particularly its mounting and contour will be explained in greater detail hereinbelow.

As with similar paper making devices, a uniform quantity of moisture may be applied to the backside of the transfer felt 16 by a water shower or other suitable device (not shown) to facilitate the sliding of the transfer felt 16 over the transfer shoe 30 as well as the pick-up of the web 10 when contact is made with the felt 16.

After the web 10 has been removed from the forming fabric 12 by the transfer felt 16, it may be transferred to a press section 14 or other suitable device for the further removal of water by a pressing action between a plurality of rolls or by a Thru-Air-Dried section or directly to a yankee dryer as discussed hereinabove. The press section 14 may be of any suitable design depending upon the nature of the web 10 formed on the forming fabric 12.

Figure 2:
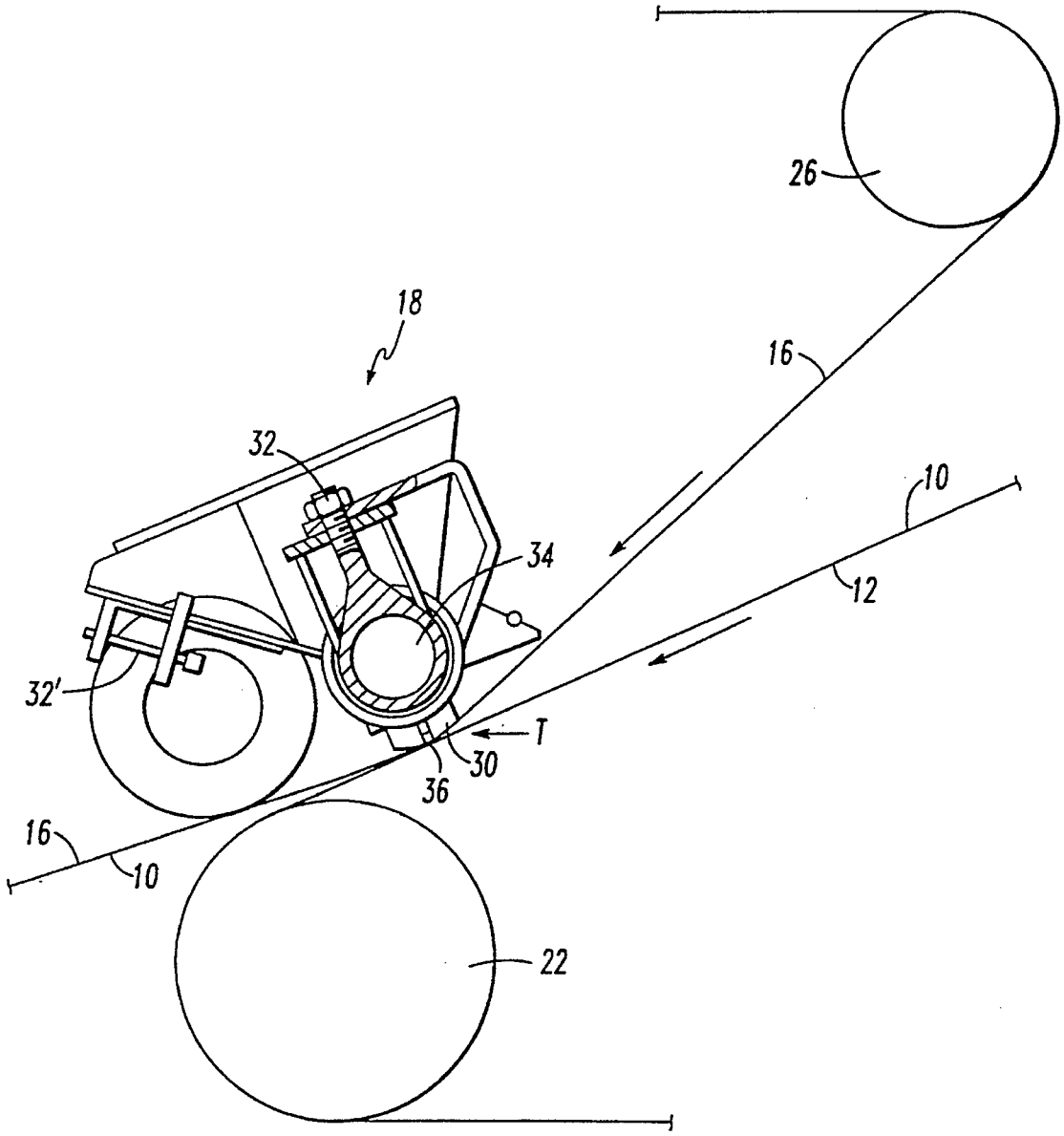
FIG. 2 is an expanded view of a portion of FIG. 1.

Referring now to FIG. 2, as discussed previously, the forming fabric 12 carrying the web 10 passes in a downward descent toward roll 22 where the forming fabric 12 is returned to the web making station in a substantially continuous loop. Similarly, the transfer felt 16 passes about roll 26 in a downward descent towards the web 10 and forming fabric 12. As can be seen from FIG. 2, the transfer station 18 is positioned so as to apply an intense pressure against an inner surface of the transfer felt 16 by way of the transfer chute 30 which is carried out in the transfer zone T. The transfer station 18 is in the form of a suction box which is positioned inside the substantially continuous loop of transfer felt and includes adjustment mechanisms 32 and 32' for adjusting the position of the transfer device 18 with respect to the forming fabric 12. In doing so, the pressure applied by the transfer shoe 30 to the inner surface of the transfer felt 16 and consequently the web 10 and forming fabric 12 may be readily adjusted. The adjustment mechanisms can take on any available structure so long as the positioning of the transfer shoe 30 with respect to the forming fabric 12 can be readily and accurately adjusted.

The suction box includes a vacuum chamber 34 which communicates with the transfer felt 16 through a vacuum passage 36 formed in the transfer shoe 30. It is the combination of the pressure applied by the transfer device 18 through the transfer shoe 30 as well as the vacuum applied to the transfer felt 16 through vacuum passage 36 in the transfer shoe 30 which transfers the web 10 from the forming fabric 12 to the transfer felt 16.

In prior art transfer devices, the radius of curvature of the transfer shoe 30 is in most instances substantially constant and on the order of approximately 4 inches. Such a transfer shoe is generally illustrated in U.S. Pat. No. 4,440,597 issued to Wells, et at. Therein, the transfer felt, web and forming fabric are passed over an outer surface of the transfer shoe which with the aid of a vacuum transfers the web from the forming fabric to the transfer felt for further processing. With transfer shoes of the type illustrated in the above-noted patent, the transfer shoe must exert a significant pressure on the transfer felt and consequently the web and forming fabric over an extended distance in order to properly transfer the web from the forming fabric to the transfer felt. Often times, this results in breakage of the web and consequently an interruption in the operation of the paper making machine which results in down time and consequently results in the reduction in the output of the machine itself. In this regard, it is the contour of the transfer shoe 30 which constitutes an essential feature of the present invention.

Figure 4:
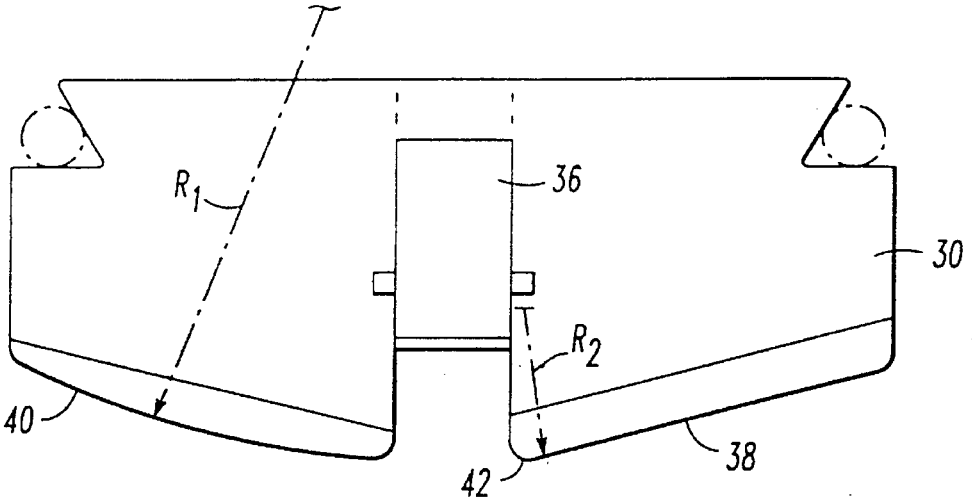
FIG. 4 is a cross-sectional view of the transfer shoe in accordance with the present invention.
Figure 3:
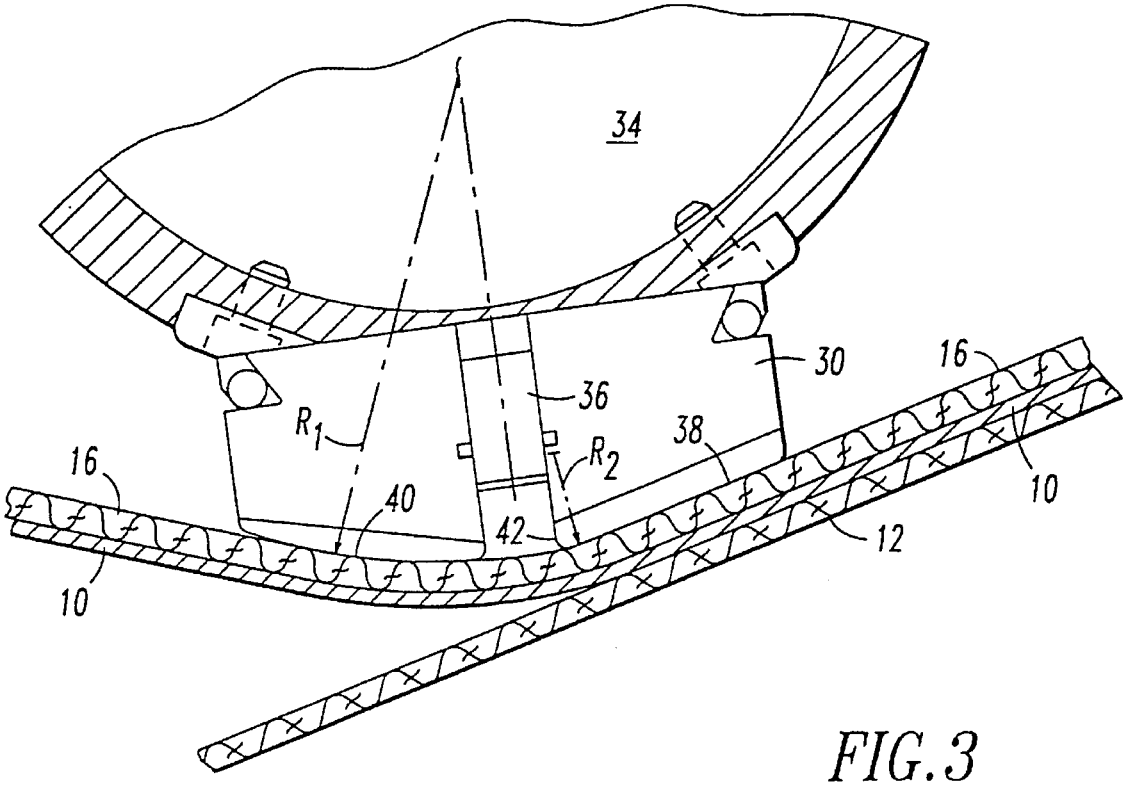
FIG. 3 is yet a further expanded view of a portion of FIG. 2 illustrating the web transfer device in accordance with the present invention.

As can be seen from FIGS. 3 and 4, the transfer shoe 30 which is an elongated element which extends transversely across the width of the transfer felt 16 includes a substantially planar lead-in surface 38 which initially directs the transfer felt 16 to the transfer zone T. Similarly, the web 10 and forming fabric 12 are likewise directed to the transfer zone T in the manner discussed hereinabove. As with previous transfer shoes, the transfer shoe 30 includes an arcuate exiting surface 40 which directs the transfer felt 16 as well as the now transferred web 10 away from the forming fabric 12 for further processing. This exiting surface has a radius $R_1$ in the range of 2.0 to 6.0 inches and preferably 4.0 inches which permits the web 10 to remain in contact with the transfer felt 16 while being directed away from the forming fabric 12. The substantially planar lead-in surface 38 includes an arcuate trailing edge 42 having a predetermined radius of curvature $R_2$ in the range of 0.5 to 1.5 inches and preferably 1.0 inches. The significance of the reduced radius arcuate trailing edge 42 of the planar lead-in surface 38 will be discussed in greater detail hereinbelow.

As discussed previously, the transfer shoe 30 includes a vacuum passage 36 formed therein which communicates with the vacuum chamber 34 formed in the transfer device 18. The transfer shoe 30 may be mounted on the vacuum chamber 34 in any known manner so as to accurately secure its position with respect to the forming fabric 12. In accordance with the present invention, it is the combination of the arcuate reduced radius trailing edge 42 and the arcuate exiting surface 40 which result in a significant increase in the production in a paper making machine incorporating such a transfer shoe. This is realized because of the increased pick up effectiveness of the transfer shoe 30 in accordance with the present invention which results in less breaks of the web 10 being manufactured in such a paper making machine. Tests have shown that an increase in production of approximately 15 tons per day can be realized when utilizing the transfer shoe in accordance with the present invention.

Figure 5:
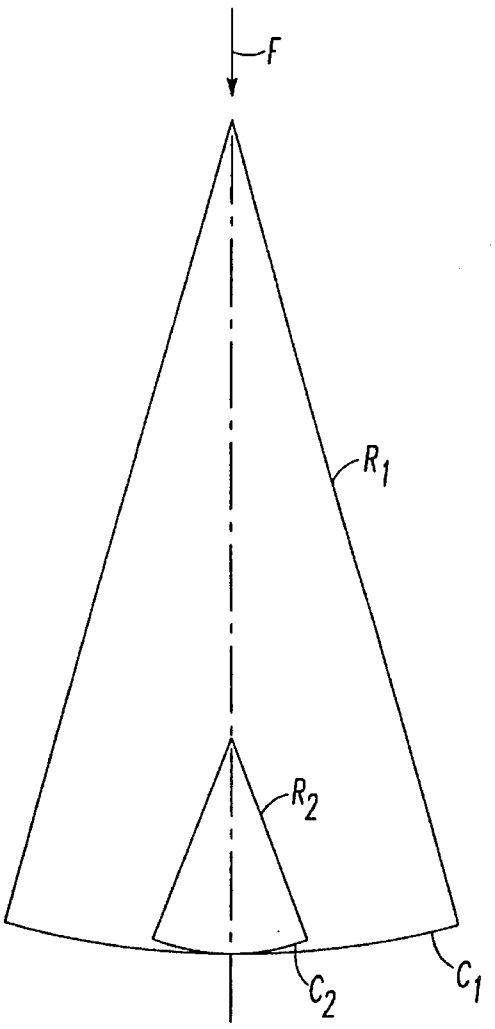
FIG. 5 is a forced diagram illustrating the comparative forces between the present invention and that of the prior art.

This is accomplished because the effective pressure acting on the transfer felt 16 and subsequently the web 10 is concentrated in a smaller area of the transfer shoe 30. As illustrated in FIG. 5, having an effective radius $R_1$ over the entire transfer surface of the transfer shoe 30 results in the application of a pressure expanding over the circumferential distance $C_1$ illustrated in FIG. 5. With a transfer shoe formed in accordance with the present invention, and having an effective radius $R_2$ in the transfer zone which applies a force over an area $C_2$ clearly results in an effective PSI which is approximately three times greater than that of a transfer shoe of the radius $R_1$ when a constant force F is applied thereto. Accordingly, because a greater effective pressure is realized in accordance with the present invention, the transfer shoe aided by the vacuum formed in the suction chamber 34 readily transfers the web 10 to the transfer felt 16. Moreover, because the effective pressure is applied in a concentrated area, the chance of breakage of the web 10 is reduced as compared to conventional transfer shoes. Consequently, as discussed hereinabove, the likelihood of breakage of the web is reduced, thus minimizing the down time of the paper making machine while simultaneously increasing the daily production of such machine.

Accordingly, the method for transferring a web from a forming fabric in a forming section of a paper making machine to a transfer felt in a rapid and reliable manner discussed in detail hereinabove includes directing the web carrying forming fabric in a substantially longitudinal direction adjacent an underside of a transfer shoe in a transfer zone the said web being positioned between the forming fabric and the transfer shoe and the transfer shoe having a substantially planer lead-in surface and an arcuate exiting surface of a predetermined radius, the lead-in surface including an arcuate trailing edge having a predetermined radius less than that of the arcuate exiting surface with the trailing edge and the exiting surface being separated by a suction opening, directing the transfer felt in a substantially longitudinal direction adjacent the underside of the transfer shoe with the transfer felt being positioned between the web and the transfer shoe, the transfer felt entering the transfer zone at an angle with respect to the forming fabric, creating a nip region adjacent the arcuate trailing edge where the transfer felt is pressed against the web in a concentrated area for initiating the transfer of the web from the forming fabric to the transfer felt, applying a suction to the web through the transfer felt adjacent the suction opening whereby the web is transferred from the forming fabric to the transfer felt and directing the transfer felt and transferred web over the arcuate exiting surface and away from the forming fabric. Similarly, the apparatus for transferring the web from the forming fabric to the transfer felt in the transfer zone of the paper making machine discussed hereinabove comprises a substantially continuous web carrying forming fabric travelling in a substantially closed loop and passing through the transfer zone, a substantially continuous transfer felt travelling in a substantially closed loop and passing through the said transfer zone, a transfer device for transferring the web from the forming fabric to the transfer felt, the transfer device including a substantially planer lead-in surface having an arcuate trailing edge of a predetermined radius and an arcuate exiting surface of a predetermined radius with the predetermined radius of the arcuate trailing edge being less than the predetermined radius of the arcuate exiting surface, a suction opening positioned between the lead-in surface and the arcuate exiting surface and a vacuum device for creating a vacuum in the suction opening for causing the web to transfer from the forming fabric to the transfer felt in the transfer zone wherein a greater transfer force is realized in the transfer zone than with previous transfer devices. With the aforementioned method and apparatus the likelihood of breakage of the web is reduced, thus minimizing the down time of the paper making machine while simultaneously increasing the daily production of such machine.

While the present invention has been described with reference to the preferred embodiment, it will be appreciated by those skilled in the art that the invention may be practiced otherwise than as specifically described herein without departing from the spirit and scope of the invention. It is, therefore, to be understood that the spirit and scope of the invention be limited only by the appended claims.

I claim:

1. A method for transferring a web from a forming, fabric in a forming section of a paper making machine to a transfer fabric comprising:

directing the web carrying forming fabric in a substantially longitudinal direction adjacent an underside of a transfer shoe in a transfer zone with said web being positioned between the forming fabric and the transfer shoe, the transfer shoe having a substantially planer lead-in surface and an arcuate exiting surface of a predetermined radius of curvature, said lead-in surface including an arcuate trailing edge having a predetermined radius of curvature less than that of said arcuate exiting surface, said trailing edge and said exiting surface being separated by a suction opening;

directing the transfer fabric in a substantially longitudinal direction adjacent the underside of the transfer shoe with the transfer fabric being positioned between said web and the transfer shoe, the transfer fabric entering said transfer zone at an angle with respect to the forming fabric;

creating a nip region between the arcuate trailing edge of the transfer shoe and the forming fabric where the transfer fabric is pressed against the web in a concentrated area for initiating the transfer of the web from the forming fabric to the transfer fabric;

applying a suction to the web through the transfer felt adjacent the suction opening whereby the web is transferred from the forming fabric to the transfer fabric; and directing the transfer fabric and transferred web over said arcuate exiting surface and away from said forming fabric.

2. The method as defined in claim 1, wherein said predetermined radius of curvature of said arcuate exiting surface of the transfer shoe is in a range of 2.0 to 6.0 inches.

3. The method as defined in claim 2, wherein said predetermined radius of curvature of said arcuate exiting surface of the transfer shoe is approximately 4.0 inches.

4. The method as defined in claim 3, wherein said predetermined radius of curvature of said arcuate trailing edge is in a range of 0.5 to 1.5 inches.

5. The method as defined in claim 4, wherein said predetermined radius of curvature of said arcuate trailing edge is approximately 1.0 inch.

6. The method as defined in claim 1, wherein said predetermined radius of curvature of said arcuate trailing edge is in a range of 0.5 to 1.5 inches.

7. The method as defined in claim 6, wherein said predetermined radius of curvature of said arcuate trailing edge is approximately 1.0 inch.

8. The method as defined in claim 1, wherein the transfer fabric enters the transfer zone at an angle in the range of 10 to 20 degrees with respect to the forming wire.

9. The method as defined in claim 8, wherein the transfer fabric enters the transfer zone at an angle of 15 degrees with respect to the forming wire.

10. A transfer shoe for separating a web from a forming fabric and transferring the web to a transfer fabric in a paper making machine, said transfer shoe comprising;

a substantially planer lead-in surface having an arcuate trailing edge of a predetermined radius of curvature;

an arcuate exiting surface of a predetermined radius of curvature, said predetermined radius of curvature of said arcuate trailing edge being less than said predetermined radius of curvature of said arcuate exiting surface; and a suction opening positioned between said lead-in surface and said arcuate exiting surface.

11. The transfer shoe as defined in claim 10, wherein said predetermined radius of curvature of said arcuate exiting surface is in a range of 2.0 to 6.0 inches.

12. The transfer shoe as defined in claim 11, wherein said predetermined radius of curvature of said arcuate exiting surface is approximately 4.0 inches.

13. The transfer shoe as defined in claim 12, wherein said predetermined radius of curvature of said arcuate trailing edge is in a range of 0.5 to 1.5 inches.

14. The transfer shoe as defined in claim 13, wherein said predetermined radius of curvature of said arcuate trailing edge is approximately 1.0 inch.

15. The transfer shoe as defined in claim 10, wherein said predetermined radius of curvature of said arcuate trailing edge is in a range of 0.5 to 1.5 inches.

16. The transfer shoe as defined in claim 15, wherein said predetermined radius of curvature of said arcuate trailing edge is approximately 1.0 inch.

17. An apparatus for transferring a web from a forming fabric to a transfer felt in a transfer zone of a paper making machine comprising:

a substantially continuous web carrying forming fabric travelling in a substantially closed loop and passing through the transfer zone;

a substantially continuous transfer fabric travelling in a substantially closed loop and passing through said transfer zone;

a transfer means for transferring the web from the forming fabric to the transfer fabric, said transfer means including a substantially planer lead-in surface having an arcuate trailing edge of a predetermined radius of curvature, an arcuate exiting surface of a predetermined radius of curvature, said predetermined radius of curvature of said arcuate trailing edge being less than said predetermined radius of curvature of said arcuate exiting surface; and a suction opening positioned between said lead-in surface and said arcuate exiting surface; and a vacuum means for creating a vacuum in said suction opening for causing the web to transfer from the forming fabric to the transfer fabric in the transfer zone.

18. The apparatus as defined in claim 17, wherein said substantially continuous web carrying forming fabric and said substantially continuous transfer fabric converge towards one another at said transfer zone and are pressed against one another adjacent said arcuate trailing edge of said transfer means.

19. The apparatus as defined in claim 18, wherein said substantially continuous transfer fabric is positioned between said transfer means and said substantially continuous forming fabric with said web disposed therebetween.

20. The apparatus as defined in claim 17, wherein said predetermined radius of curvature of said arcuate exiting surface is in a range of 2.0 to 6.0 inches.

21. The apparatus as defined in claim 20, wherein said predetermined radius of curvature of said arcuate exiting surface is approximately 4.0 inches.

22. The apparatus as defined in claim 17, wherein said predetermined radius of curvature of said arcuate trailing edge is in a range of 0.5 to 1.5 inches.

23. The apparatus as defined in claim 22, wherein said predetermined radius of curvature of said arcuate trailing edge is approximately 1.0 inch.

* * * * *